United States Patent [19]

Kato

[11] Patent Number: 4,685,870

[45] Date of Patent: Aug. 11, 1987

[54] FUEL INJECTION PUMP FOR INTERNAL COMBUSTION ENGINES

[75] Inventor: Yushi Kato, Higashimatsuyama, Japan

[73] Assignee: Diesel Kiki Co., Ltd., Tokyo, Japan

[21] Appl. No.: 859,643

[22] Filed: May 5, 1986

[30] Foreign Application Priority Data

May 14, 1985 [JP] Japan ..... 60-100621
Feb. 25, 1986 [JP] Japan ..... 61-38284

[51] Int. Cl.[4] ..... F04B 7/06; F04B 39/10; F02M 37/04

[52] U.S. Cl. ..... 417/500; 417/490; 123/496; 123/449

[58] Field of Search ..... 417/490, 500; 123/496, 123/449, 503

[56] References Cited

U.S. PATENT DOCUMENTS

| | | | |
|---|---|---|---|
| 1,865,099 | 6/1932 | Groff | 123/496 |
| 2,804,825 | 9/1957 | Mansfield | 417/490 |
| 2,871,796 | 2/1959 | Dreisin | 417/494 |
| 3,965,875 | 6/1976 | Perr | 123/496 |
| 4,029,071 | 6/1977 | Saito | 123/496 |
| 4,478,196 | 10/1984 | Hafner | 123/496 |
| 4,567,868 | 2/1986 | Yasuhara | 123/449 |

FOREIGN PATENT DOCUMENTS

| | | | |
|---|---|---|---|
| 58-113869 | 8/1983 | Japan . | |
| 59-131570 | 9/1984 | Japan . | |
| 59-194564 | 12/1984 | Japan . | |
| 277678 | 4/1929 | United Kingdom | 123/496 |
| 318889 | 8/1930 | United Kingdom | 123/496 |

*Primary Examiner*—Carlton R. Croyle
*Assistant Examiner*—Jane L. Obee
*Attorney, Agent, or Firm*—Frishauf, Holtz, Goodman & Woodward

[57] ABSTRACT

A fuel injection pump for an internal combustion engine comprises a cam disc having a camming surface which, when the cam disc is rotatively driven, causes a plunger to be rotated and reciprocated to allow drawn fuel to be pressurized and distributed, to thereby deliver the pressurized fuel to the engine. The camming surface is configured such that the plunger is moved substantially at a constant velocity for the engine idling, and after the termination of the constant velocity region the velocity of movement of the plunger is increased to a highest value higher than that for the engine idling, and before entering the constant velocity region the plunger is moved at a velocity higher than the above constant velocity but lower than the highest value.

6 Claims, 4 Drawing Figures

FUEL INJECTION PUMP FOR INTERNAL COMBUSTION ENGINES

BACKGROUND OF THE INVENTION

The present invention relates to a fuel injection pump for supplying fuel to an internal combustion engine through fuel injection nozzles and, more particularly, to a fuel injection pump which can reduce noise in an idling range of the engine and secure required output in other engine operating ranges.

Conventional injection rate control devices provided in fuel injection pumps include a type which is so arranged as to leak a portion of fuel to achieve a low rate of injection during low-speed running of an internal combustion engine, as disclosed in Japanese Provisional Utility Model Publications (Kokai) Nos. 59-131570 and 59-194564. However, such conventional fuel injection pump requires the provision of a means for causing the portion of fuel to be leaked, making the structure complicated.

Japanese Provisional Utility Model Publication (Kokai) No. 58-113869 discloses a fuel injection pump for an internal combustion engine, provided with an injection rate control device which utilizes a control circuit and an actuator for controlling the axial position of a control sleeve with respect to a plunger, to alter the portion of a cam to be used, in accordance with operating conditions of the engine, to thereby enable a reduction in noise in an idling range of the engine and secureness of required output in other engine operating ranges. To this end, the fuel injection pump is required to have an electronic control circuit, thus being high in cost.

OBJECTS AND SUMMARY OF THE INVENTION

An object of the invention is to provide a fuel injection pump for an internal combustion engine, which can achieve a low rate of injection during idling of the engine and a high rate of injection during full load operation of the engine without shift in injection timing, by means of a novel cam configuration.

Another object of the invention is to provide a fuel injection pump which can obtain a low rate of injection during an idling range of the engine and a high rate of injection during other operating ranges of the engine, by means of a novel cam configuration enabling to achieve a greater amount of plunger lift with a less extent of angular movement.

According to the invention, there is provided a fuel injection pump for an internal combustion engine, comprising:

a plunger disposed to be rotated and reciprocated; and cam means having a camming surface operatively coupled with the plunger and disposed to be rotatively driven for causing rotation and reciprocation of the plunger to cause same to pressurize drawn fuel and distribute the pressurized fuel, to thereby deliver the pressurized fuel to the engine;

the camming surface of the cam means has such a configuration as to include a first angular region for causing the plunger to be lifted for pressurizing drawn fuel during idling of the engine at a first, substantially constant velocity, and a second angular region subsequent to the first angular region, for causing the plunger to be lifted for pressurizing drawn fuel at a second velocity higher than the first velocity, and a third angular region preceding to said first angular region, for causing the plunger to be lifted for pressurizing drawn fuel at a velocity higher than said first velocity, but lower than said second velocity.

The above and other objects, features, and advantages of the invention will be more apparent from the ensuing detailed description, taken in conjunction with the accompanying drawings.

DETAILED DESCRIPTION

Figure 1:
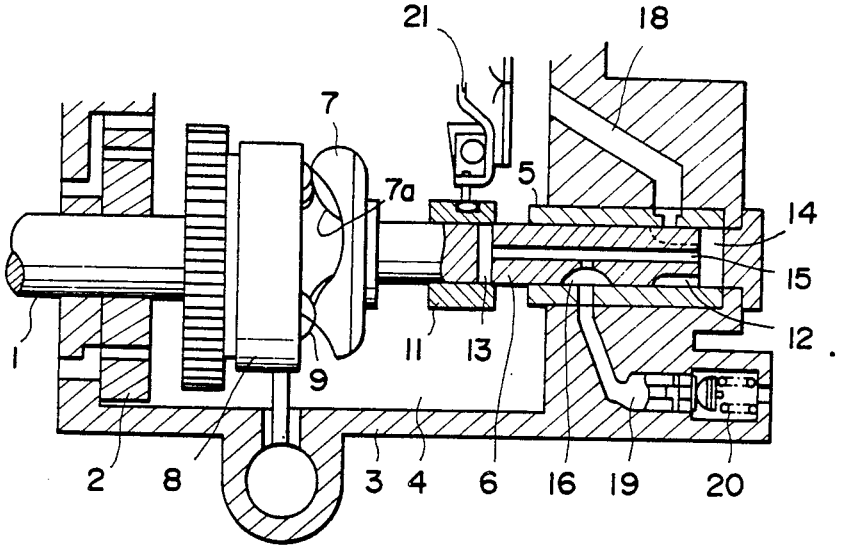
FIG. 1 is a fragmentary, longitudinal cross-sectional view showing a fuel injection pump in accordance with an embodiment of the present invention.

Referring to FIG. 1, a fuel injection pump apparatus in accordance with an embodiment of the present invention comprises a pump housing 3, and a feed pump 2 driven by an internal combustion engine, not shown, through a drive shaft 1 for drawing fuel from a fuel tank, not shown, and pressurizing and delivering same to a suction space 4 defined within the pump housing 3. The pressure of fuel within the suction space 4 is regulated to a value dependent upon the rotational speed of the engine by a pressure regulating valve, not shown, provided in a bypass passage communicating suction and discharge sides of the feed pump 2 with each other. A pumping and distributing plunger 6 is rotatably and slidably fitted in a plunger barrel 5 fixedly secured to the pump housing 3. The wall of the pump housing 3, the plunger barrel 5 and the plunger 6 cooperate with each other to define a pump working chamber 14. A cam disc 7 is secured on a base end of the plunger 6, and is coupled to the drive shaft 1 for rotation in unison therewith but for axial movement relative thereto by means of a driving disc, not shown.

The cam disc 7 has one side surface formed with a camming surface *7a*, to be described later, which has circumferentially arranged highs corresponding in number to the number of cylinders of the engine. The camming surface is held in abutting engagement with rollers 9 on a roller holder 8 by means of a plunger spring, not shown. With the arrangement, the plunger 6 is rotated in response to the rotation of the drive shaft 1 while being reciprocated by the rolling guide action of the rollers 9 on the camming surface of the cam disc 7, to thereby perform the drawing, pressurizing, distributing and pressure delivering of the fuel.

The plunger 6 is formed with suction slits 12 corresponding in number to the number of the engine cylinders, a cut-off port 13 cooperating with a control sleeve 11 slidably mounted on the plunger 6 to terminate the injection of fuel, an axially extending communication bore 15 communicating the pump working chamber 14 and the cut-off port 13 with each other, and a distributing groove 16 communicating with the communication bore 15.

Delivery passages 19 corresponding in number to the number of the engine cylinders and circumferentially equidistantly arranged extend through the barrel 5 and the pump housing 3 and are so located as to successively communicate with the distributing groove 16 at predetermined timing as the plunger 6 is rotated and reciprocated. The delivery passages 19 are provided therein with respective delivery valves 20 and are in communication with the respective engine cylinders through respective injection pipes, not shown.

The control sleeve 11 is controlled so as to take a position commensurate with the load on the engine through a control lever 21 by means of a governor mechanism, not shown, to control the injection quantity in cooperation with the cut-off port 13. As the cut-off port 13 becomes out of an axial end edge of the control sleeve 11 and open to the suction space 4, the fuel within the pump working chamber 14 flows into the suction space 4 so that the injection is terminated.

Figure 2:
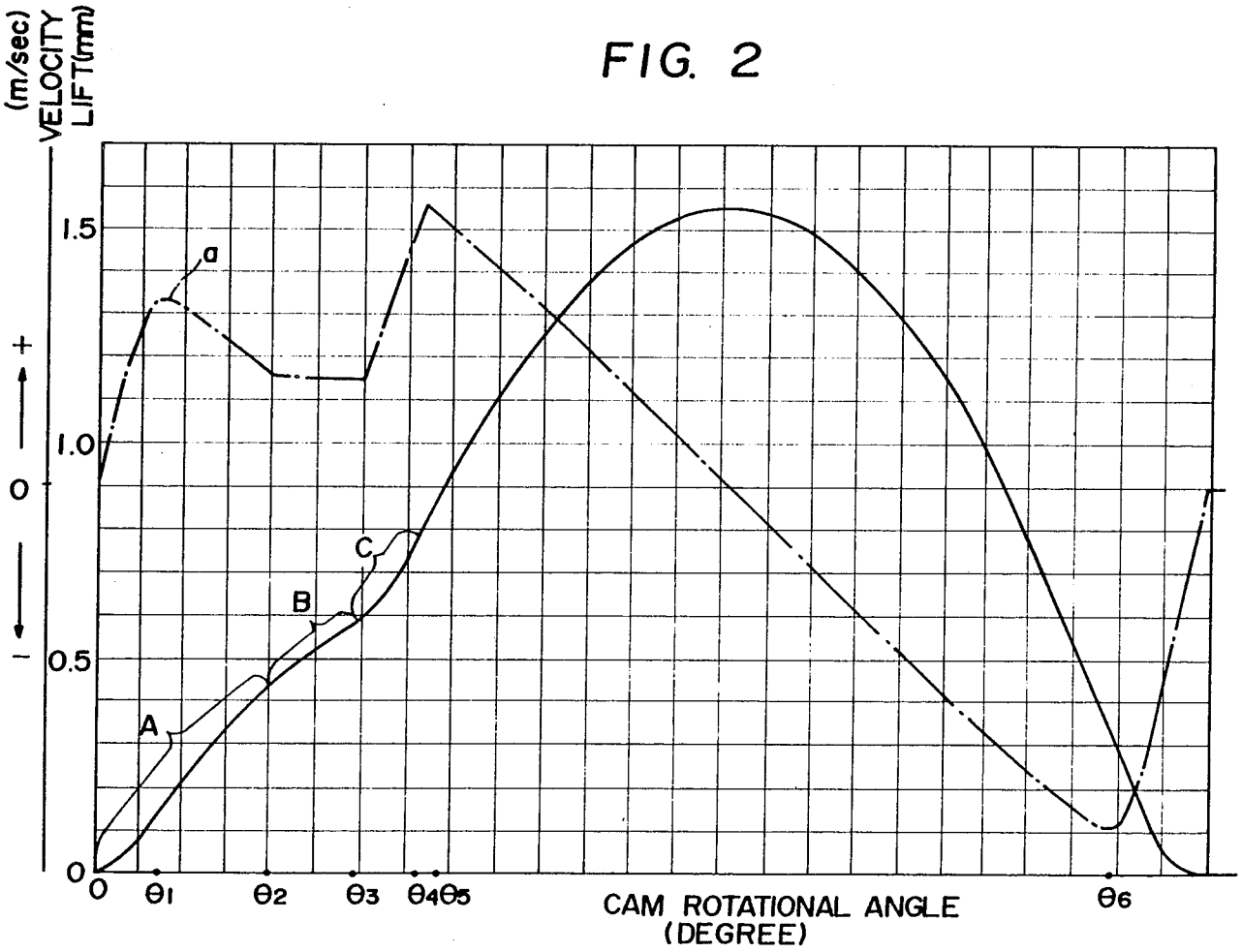
FIG. 2 is a graph useful in explaining the configuration of a camming surface of a cam disc shown in FIG. 1 and showing the velocity and lift of the plunger plotted with respect to cam rotational angle.

The configuration of the camming surface *7a* of the cam disc 7 will be described with reference to FIG. 2. In FIG. 2, the dot-and-dash line indicates the velocity of movement of the plunger 6, and the solid line indicates the lift of the plunger 6, with the abscissa being indicative of the rotational angle of the cam disc 7.

In FIG. 2 the zero rotational angle "0" of the cam disc 7 corresponds to the leftmost position of the plunger 6 as viewed in FIG. 1. The camming surface *7a* is configured so as to include an angular region A ranging from zero (0) to $\theta_2$ in which the velocity of the plunger 6 has a maximun point a at $\theta_1$ of the rotational angle of the cam disc 7 and is gradually decreased until $\theta_2$. At $\theta_2$, the velocity of the plunger 6 is approximately 0.25 m/sec. In an angular region B ranging from $\theta_2$ to $\theta_3$ subsequent to the termination of the region A of from zero to $\theta_2$, the velocity of the plunger 6 is maintained substantially constant, i.e., at approximately 0.25 m/sec. In the region B of from $\theta_2$ to $\theta_3$ where the plunger velocity is substantially constant the cam angle is set to such values as to obtain an injection quantity required for the engine idling. The velocity of the plunger in the region B from $\theta_2$ to $\theta_3$ is set to a value appropriate to obtain such a moderately low rate of injection as does not deteriorate the combustion condition of the engine but enables slow or gentle combustion. In an angular region C from $\theta$hd 3 to $\theta_4$ subsequent to the termination of the range B from $\theta_2$ to $\theta_3$, the velocity of the plunger 6 is increased and is highest at $\theta_4$ at which the velocity is approximately 0.65 to 0.7 m/sec. Subsequently, the velocity of the plunger 6 is decreased toward $\theta$hd 6 and, subsequently, is increased toward the reference position or zero cam angle. The plunger velocity in the region C from $\theta_3$ to $\theta_4$ is set to a value appropriate to obtain a rate of injection necessary and sufficient to achieve required output. Thus, the plunger 6 has the lift characteristic indicated by the solid line in FIG. 2.

The operation of the fuel injection pump shown in FIG. 1 will now be described.

As the drive shaft 1 is rotated, the plunger 6 is rotated and reciprocated. As the plunger 1 is moving through a suction stroke, that is, moving leftwardly in FIG. 1, fuel in the suction space 4 is drawn through the suction passage 18 into the pump working chamber 14 through the corresponding suction slit 12.

As the suction passage 18 becomes out of communication with the corresponding suction slit 12 and is moved to the right in FIG. 1, the fuel in the pump working chamber 14 is pressurized, is delivered to the corresponding delivery passage 19 through the communication bore 15 and the distributing groove 16, and is pressure delivered to a corresponding injection nozzle provided in the corresponding engine cylinder through the corresponding delivery valve 20 and the corresponding injection pipe. The fuel injection by the fuel injection pump is initiated from the time the pressure in the injection pipe reaches an injection initiating value set for the injection nozzle. To this end, it is required to reduce the volume of the pump working chamber 14 from the time the plunger initiates pressure delivery to the time the plunger is lifted by a predetermined amount and the pressure in the pump working chamber and the injection pipe reaches a value equal to or higher than the injection initiating pressure. The amount of lift is determined by the specifications of the delivery valve, the length and cross section of the injection pipe and the injection initiating pressure. Thus, the present invention is so arranged as to render the lift velocity of the plunger fast at the initial stage of the pressure delivery of fuel, to obtain a great amount of lift with a less extent of angular movement of the cam disc.

With the arrangement described above, it is possible to increase the pressure within the injection pipe to the injection initiating pressure as the plunger moves within the angular region A of from 0 to $\theta_1$, which makes it possible to inject the fuel in the subsequent region B in which the plunger velocity is low or substantially constant, thus achieving a low rate of injection in the idling range, and accordingly reduced noise. When the injection quantity is set to an increased value, the fuel injection is continued also in the high velocity region subsequent to $\theta_3$, so that fuel is injected at a high rate, making is possible to secure sufficient output required for this region.

Explanation will be made using specific numerical values. As the lift of the plunger 6 proceeds to approximately 0.43 mm, the pressure in the injection pipe reaches a prescribed injection initiating value set for the associated injection nozzle and the injection is initiated. The angular position of the cam disc 7 at this time is $\theta_2$. If the plunger 6 has a diameter of 9 mm, fuel is injected in a quantity of 63.6 $mm^3$ ($=1\times9^2\times\pi/4$) for one stroke of 1 mm. If the injection quantity is 10 $mm^3$/stroke during idling, the injection is terminated at the time the displacement of the plunger 6 reaches approximately 0.59 mm, whereupon the angular position of the cam disc 7 is $\theta_3$. The velocity of the plunger 6 is approximately 0.25 m/sec during the idling, so that a moderately low mean rate of injection is obtained during the idling.

On the other hand, if the injection quantity is 30 $mm^3$/stroke during full load operation, the displacement of the plunger 6 is approximately 0.9 mm at the termination of injection, and the angular position of the cam disc 7 at this time is $\theta_5$. Consequently, the plunger 6 is moved at the same velocity as that during the idling and, thereafter, the moving velocity is increased up to the highest value at $\theta_4$ at which the velocity is approximately 0.65 to 0.7 m/sec. The mean velocity 7 of the plunger 6 during full load operation is higher as compared with that during the idling, so that the mean rate of injection is also increased by the difference in the mean velocity, i.e. about 1.55 times as high as the mean rate of injection during the idling. The ratio between the two mean rates of injection in the present invention is much greater than that in conventional fuel injection pumps.

The fuel injection is terminated when the cut-off port 13 is out of alignment with the edge of the control sleeve 11 to open into the suction space 4 to allow the fuel within the pump working chamber 14 to flow into the suction chamber 4, to thereby reduce the pressure within the pump working chamber 14.

Figure 3:
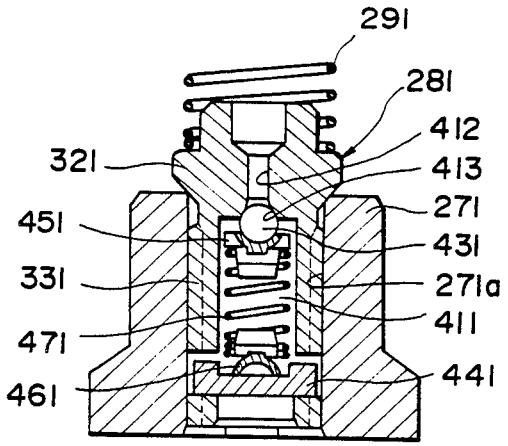
FIG. 3 is a longitudinal cross-sectional view showing a two-way delivery valve incorporated into a second embodiment of the present invention.

A second embodiment of the present invention will now be described with reference to FIG. 3. The second embodiment utilizes a two-way delivery valve as the delivery valve 20 shown in FIG. 1, and is identical in other structure and operation of the fuel injection pump per se with the first embodiment shown in FIG. 1.

The two-way delivery valve comprises a valve body 281 formed at one end thereof with a seat section 321 which has a spring retaining portion for retaining a coil spring 291 and a seat surface abutting against a valve seat 271 having a central through bore 271*a* formed therethrough. The valve body 281 is formed at the other end with a guide section 331 in the form of blades which is slidably fitted in the central through bore 271*a* in the valve seat 271.

Further, the valve body 281 is formed therein with a communication passage allowing upstream and downstream sides of the valve body 281 to communicate with each other. The passage comprises a first passage section 412 reduced in diameter and a second passage section 411 enlarged in diameter, and a seat portion 413 is defined at a step between the first and second passage sections. A ball valve element 431 is arranged in the second passage section 411, and an abutment 441 is disposed adjacent an inner or free end of the second passage section 411. A coil spring 471 is arranged between the abutment 441 and the ball valve element 431 through spring retainers 451 and 461. Thus, the two-way delivery valve is formed therein with a relief valve for maintaining constant the pressure within the injection pipe.

With the arrangement described above, during the fuel pressurizing stroke of the pump, the valve body 281 is displaced against the force of the spring 291 due to the increase in pressure within the pump working chamber 14, so that fuel is delivered into the injection pipe through gaps between the valve seat 271 and the guide section 331, to allow the fuel to be injected.

Upon the termination of the injection, the valve body 281 is seated on the valve seat 271 and, thereafter, the ball valve element 431 is displaced against the force of the spring 471 by the pressure within the injection pipe to maintain the residual pressure within the injection pipe at a value set by the spring 471. The second embodiment utilizes the two-way delivery valve as arranged above, to maintain the residual pressure at 50% of the injection initiating pressure, to thereby reduce the amount of plunger lift required to obtain the injection initiating pressure. With the arrangement, it is possible to reduce the amount of plunger lift and the rotational angle of the cam disc to be executed during the initial stage of rotation of the cam disc in order to obtain the injection initiating pressure. This facilitates designing of the cam disc and increases the freedom or variety of designing the cam.

Incidentally, even if the residual pressure is set to a value of the order of 35% to 75% of the injection initiating pressure, similar results can be achieved.

If the set valve opening pressure of the ball valve element, i.e. set residual pressure is equal to or above 35% of the injection initiating pressure, it is possible to maintain the residual pressure within the injection pipe at a level equal to or above the residual pressure (of the order of 30% at most) obtainable by the use of an ordinary delivery valve, so that it is possible to reduce the amount of plunger lift required to obtain the injection initiating pressure, thereby facilitating achievement of the object of the invention. In addition, since the residual pressure within the injection pipe can be maintained constant, it is possible to reduce the variation in the quantity of injection, etc. as compared with the use of the ordinary delivery valve.

Moreover, if the set residual pressure is equal to or below 75%, it is possible to solve such problems in the injection system as remarkable reduction in the durability of the two-way delivery valve, and irregular injection due to excessive increase in the residual pressure.

Figure 4:
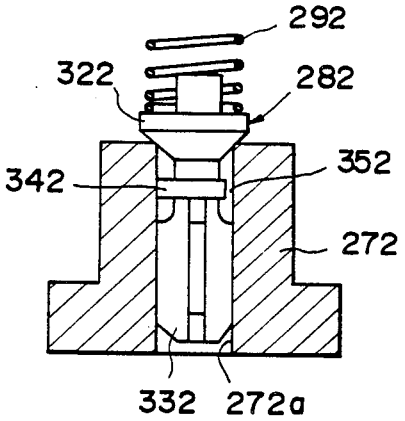
FIG. 4 is a longitudinal cross-sectional view showing an adaptation type delivery valve incorporated into a third embodiment of the present invention.

A third embodiment of the present invention will now be described with reference to FIG. 4. The third embodiment utilizes an adaptation type delivery valve as the delivery valve 20 shown in FIG. 1, and is identical in other structure and operation of the fuel injection pump per se with the first embodiment shown in FIG. 1. As shown in FIG. 4, a valve body 282 is formed at one end thereof with a seat section 322 which has a spring retaining surface for retaining a spring 292 similar to the spring 291 shown in FIG. 3, and a seat surface abutting against a valve seat 272 having a central bore 272*a* formed therethrough. The valve body 282 is formed at the other end with a guide section 332 in the form of blades which is slidably fitted within the central through bore 272*a* in the valve seat 272. A retraction collar 342 is formed integrally on the valve body 282 between the seat section 322 and the guide section 332 and is provided with a cut-out 352 in a peripheral edge of the collar 342. Except for the cut-out 352 in the collar 342, the delivery valve in FIG. 4 is substantially identical in structure with the delivey valve 20 shown in FIG. 1. With the arrangement described above, during low rotational speed operation of the engine, the valve body 282 moves slowly to allow part of the retraction fuel to freely flow back through a gap between the cut-out 352 and the bore 272*a* from an upstream side of the retraction collar 342 to a downstream side of same, i.e. the interior of the fuel injection pipe. Accordingly, the actual amount of retraction fuel is reduced so that the residual pressure within the injection pipe is increased. When the engine rotational speed is high, the valve body 282 moves fast, and the retraction fuel becomes difficult to freely flow between the fuel injection pipe and the downstream side of the retraction collar 342 through the cut-out 352, so that the amount of retraction fuel is increased with increase of the engine rotational speed. Consequently, the residual pressure within the fuel injection pipe is reduced with increase of the engine rotational speed.

Thus, during the idling, the plunger lift required to increase the pressure within the injection pipe to the injection initiating pressure is reduced, thus making it possible to initiate the injection with a less extent of rotation or smaller rotational angle of the cam disc. This enables a low rate of injection to be obtained at a low plunger velocity. When the rotational speed is high, the plunger lift required to increase the pressure within the injection pipe to the injection initiating pressure is increased, so that the injection is initiated with a greater extent of rotation or larger rotational angle of the cam disc. This enables a high rate of injection to be obtained at a high plunger velocity.

Even though, in this third embodiment, the injection initiating timing retards in the high rotational speed reqion, this can be corrected by the action of an injection timing device. Further, since the residual pressure is high during the idling, it is possible to reduce the amount of plunger lift and the extent of rotational angle of the cam disc required to initiate the fuel injection, which advantageously facilitates designing of the cam disc and increases the freedom of the design.

Incidentally, although the embodiments of the present invention have been described as being arranged such that the plunger velocity in the constant velocity region is 0.25 m/sec, another velocity may be adopted if the velocity allows the combustion to take place slowly without deteriorating the combustion condition. In addition, although the maximum velocity has been described as ranging from 0.65 to 0.7 m/sec, another velocity may be adopted if the velocity allows required output to be secured.

In addition, the fuel injection pump in accordance with another aspect of the invention is arranged such that the camming surface of the cam disc is so configured as to include an initial region ranging from zero to $\theta_2$ of the rotational angle of the cam disc, in which the plunger 6 is moved at a high velocity, an intermediate region from $\theta_2$ to $\theta_3$ in which the plunger is moved at a low, substantially constant velocity, and the remaining region in which the plunger is moved at a high velocity which is the highest.

With the arrangement of the invention, when the cam disc is rotated and passes through an initial region in which the plunger is moved at a high velocity, it is possible to increase the pressure within the fuel injection pipe communicating the fuel injection pump with a corresponding one of the fuel injection nozzles, to the injection initiating pressure within the initial region. This enables the injection to be initiated in the subsequent region in which the plunger is moved at a low, substantially constant velocity, making it possible to obtain a low rate of injection, and thus making it possible to reduce the noise during the idling.

When the amount of injection is large, the fuel injection is continued also in the subsequent high velocity region, which, therefore, makes it possible to inject the fuel at a high rate of injection, as well as to obtain required output in other regions.

As described above, the present invention can be realized merely by modifying the conventional camming surface configuration, but without modifying other parts and components of the fuel injection pump, so that the arrangement according to the invention can be extremely simple and low in cost.

The reason why the present invention provides the above-described cam configuration is that a distributor type fuel injection pump utilizing a face cam is required to supply fuel to all of the cylinders during one revolution of the cam and, further, it is required to provide a region for effecting injection timing control in which the plunger lift is zero and, therefore, the cam angular range utilizable for the injection has only [(360°/number of cylinders) - (cam angular range for injection timing control)], thus imposing a limitation upon retardation of the initiation of injection relative to the cam angle.

Thus, according to the invention sufficient plunger lift can be provided with a less angular extent of the cam, and it is made possible to increase the pressure within the injection pipe to the injection initiating pressure at an early stage of the cam rotation.

The present invention is also advantageous by the use of the two-way delivery valve or the adaptation type delivery valve, in that it is possible to provide a fuel injection pump which is even more effective and high in durability.

What is claimed is:

1. A fuel injection pump for an internal combustion engine, comprising:

a plunger disposed to be rotated and reciprocated; and cam means having a camming surface operatively coupled with the plunger and disposed to be rotatively driven for causing rotation and reciprocation of the plunger to cause same to pressurize drawn fuel and distribute the pressurized fuel, to thereby deliver the pressurized fuel to the engine;

said camming surface of the cam means having such a configuration as to include a first angular region for causing the plunger to be lifted for pressurizing drawn fuel during idling of the engine at a first, substantially constant velocity, and a second angular region subsequent to said first angular region for causing the plunger to be lifted for pressurizing drawn fuel at a second velocity higher than said first velocity, and a third angular region preceding said first angular region, for causing the plunger to be lifted for pressurizing drawn fuel at a velocity higher than said first velocity, but lower than said second velocity.

2. A fuel injection pump as defined in claim 1, including a plurality of delivery valves each disposed such that fuel pressurized by the plunger is supplied to the engine through the delivery valves, each of said delivery valves being comprised of a two-way delivery valve.

3. A fuel injection pump as defined in claim 2, wherein said two-way delivery valve comprises a valve seat having a central through bore formed therethrough, a valve body movable between a first extreme position where said central through bore in said valve seat is closed by said valve body and a second extreme position where said central through bore in said valve seat is opened by said valve body, first spring means for biasing said valve body forward of said first extreme position against fuel pressure upstream of said two-way delivery valve, said valve body of said two-way delivery valve having a passage formed therethrough and communicating with said upstream side of said two-way delivery valve and a downstream side of same, a valve element movable between a closed position where said passage in said valve body is closed by said valve element and an open position where said passage in said valve body is opened by said valve element, and second spring means disposed for biasing said valve element toward said closed position against fuel pressure downstream of said two-way delivery valve.

4. A fuel injection pump as defined in claim 1, including a plurality of delivery valves each disposed such that fuel pressurized by the plunger is supplied to the engine through the delivery valves, each of said delivery valves being comprised of an adaptation type delivery valve.

5. A fuel injection pump as defined in claim 4, wherein said adaptation type delivery valve comprises a valve seat having a central through bore formed therethrough, a valve body movable between a first position where said central through bore in said valve seat is closed by said valve body and a second position where said central through bore in said valve seat is opened by said valve body, spring means for biasing said valve body toward said first position against fuel pressure upstream of said adaptation-type delivery valve and a retraction collar provided on said valve body and disposed to be positioned within said central through bore for retracting part of fuel delivered from said adaptation-type delivery valve at least when said valve body is moving to said first position, said retraction collar being provided with at least one cut-out for allowing part of the retraction fuel to flow back therealong.

6. A fuel injection pump as defined in claim 2, wherein said two-way delivery valve has a valve opening pressure for said valve element set at 35% to 75% of an injection initiating pressure of an associated fuel injection nozzle.

* * * * *